US005913469A

United States Patent [19]

Suzuki

[11] Patent Number: 5,913,469

[45] Date of Patent: Jun. 22, 1999

[54] METHOD OF AND APPARATUS FOR ENSURING A WIRE FEED AMOUNT IN MANUFACTURING OF WIRE HARNESSES

[75] Inventor: Toshiaki Suzuki, Nagoya, Japan

[73] Assignees: Harness System Technologies Research,Ltd., Nagoya; Sumitomo Wiring Systems, Ltd., Yokkaichi; Sumitomo Electric Industries, Ltd., Osaka, all of Japan

[21] Appl. No.: 08/974,283

[22] Filed: Nov. 19, 1997

[30] Foreign Application Priority Data

Nov. 22, 1996 [JP] Japan ..... 8-312069

[51] Int. Cl.[6] ..... B65H 23/16; B65H 43/08; B65H 20/00

[52] U.S. Cl. ..... 226/36; 226/24; 226/45; 226/150; 226/187

[58] Field of Search ..... 226/110, 45, 34, 226/4, 187, 36, 24, 150, 43

[56] References Cited

U.S. PATENT DOCUMENTS

| | | | |
|---|---|---|---|
| 3,119,536 | 1/1964 | Berkeley | 226/110 |
| 3,612,369 | 10/1971 | Crebe et al. | 226/24 |
| 3,861,018 | 1/1975 | Matsuura et al. . | |
| 3,909,900 | 10/1975 | Gudmestad . | |
| 4,014,489 | 3/1977 | Bialek | 226/4 X |
| 4,192,207 | 3/1980 | Bickford et al. | 226/4 X |
| 4,461,416 | 7/1984 | Cheh | 226/187 X |
| 4,488,688 | 12/1984 | Trubitsin et al. | 226/187 X |
| 5,450,777 | 9/1995 | Molnar et al. | 226/110 X |

FOREIGN PATENT DOCUMENTS

| | | |
|---|---|---|
| 0 240 605 A2 | 10/1987 | European Pat. Off. . |
| 2 409 663 | 6/1979 | France . |

*Primary Examiner*—Michael Mansen
*Attorney, Agent, or Firm*—Oliff & Berridge, PLC

[57] ABSTRACT

Press rollers for being pressed respectively against wires are provided on an upper side of the wires while length-measuring rollers for respectively contacting the wires are provided on a lower side of the wires. A number of revolutions of each length-measuring roller is detected by an encoder, and an amount of actual feed of each wire is detected in accordance with its revolution number, and a pulse signal, representing its detection value, is sent to a comparison processing portion of a controller. In this comparison processing portion, the amount of actual feed of each wire, detected by the encoder, is compared with a predetermined feed amount of a feed roller beforehand given as an instruction to the processing portion, and if there is any difference between the two, an instruction is given to a servo amplifier, and the servo amplifier sends an instruction to a servo motor for driving the feed roller so as to rotate the servo motor in a normal or a reverse direction in accordance with this difference.

9 Claims, 11 Drawing Sheets

METHOD OF AND APPARATUS FOR ENSURING A WIRE FEED AMOUNT IN MANUFACTURING OF WIRE HARNESSES

BACKGROUND OF THE INVENTION

1. Field of the Invention

This invention relates to the manufacturing of wire harnesses, and more particularly to a method of and an apparatus for ensuring the amount of feed of wires in its manufacturing process.

2. Description of the Related Art

Electric devices in an automobile are electrically connected together by a wire harness. As shown in FIG. 10, a wire harness is formed by a method in which insulating sheathed wires a are arranged in a juxtaposed manner in a common plane, and the wires a are press-connected to connectors C at regions spaced along the length of the wires, and a lid T is fitted on and connected to each connector C.

In the manufacturing of such a wire harness W, the wires a are supplied to a processing zone where various processing, including the adjustment of the length of the wires, the installation of the wires, the cutting of the wires and the clamping of the wires to the connector C, are effected, and in these steps, the wires a have heretofore been fed, for example, by the following method. The construction and operation of this feed mechanism will be described with reference to FIG. 11.

The wire feed mechanism 115, shown in FIG. 11, includes two feed rollers 117 disposed on the lower side of the plurality of wires a, fed in a juxtaposed manner, to guide all of these wires a, and grooves 117*a*, corresponding respectively to paths of feed of these wires a, are formed in a peripheral surface of each feed roller 117, and the wires a are fitted at their lower portions in these grooves 117*a*, respectively, and therefore will not be displaced in a direction of the row of the wires.

On the upper side of the wires a, a plurality of press rollers 116*a*, corresponding respectively to the wires a, are mounted respectively on air cylinders 116 so as to move upward and downward, and when each press roller 116*a* is moved downward a predetermined amount, it cooperates with the lower-side feed roller 117 to hold the associated wire a therebetween. A drive device 118, comprising a servo motor M, a rotary encoder E and a speed reducer D, is connected to the feed rollers 117.

Each of the feed rollers 117 is driven by the servo motor M of the drive device 118, and when feeding the wires a, the wires a are pressed respectively by the upper-side press rollers 116*a*, and the length of the wires is adjusted by a method in which the revolution number and position of each feed roller 117 are detected by the rotary encoder E mounted on the servo motor M, and these detection values are transmitted to a servo amplifier Am, and an instruction indicative of the feed amount is fed from the servo amplifier Am to the servo motor M.

Such a wire feed mechanism, though simple in construction, has advantages that it is quick in response, and that a control system is stable.

However, the above feed mechanism can not absorb a variation in the rate of slip of the wires a relative to the feed rollers 117 and a variation in the outer diameter of the wires a fed from the preceding step, and these variations are directly reflected on the feed amount, thus inviting a drawback that the high-precision feed can not be achieved.

If the feed amount is too large, end portions of the wires a, fed to the connector C of the wire harness W (FIG. 10), are not properly received in the connector C, but are extended outwardly therefrom, and when fitting the lid T on the connector C, the extended portions of the wires a prevent the lid T from being fitted on the connector C. In contrast, if the feed amount is insufficient, the wires a fail to reach grooves in press-connecting terminals mounted in the connector C, and as a result the press-connection of the wires to the respective terminals can not be effected, and even if the wires only slightly reach the grooves, an insufficient mechanical strength of the press connection or other defect is encountered.

SUMMARY OF THE INVENTION

It is therefore an object of this invention to provide a wire feed mechanism which is capable of feeding wires with high precision, for example, in the manufacturing of a wire harness.

The above object has been achieved by a method of ensuring a wire feed amount in a manufacturing of a wire harness including the steps of: detecting a first feed amount each of a plurality of wires being actually fed by a feed roller driven by a motor; comparing said first feed amount with a second feed amount given as an instruction to said feed roller so as to feed the wires by a predetermined length; and controlling a rotation of said motor so that said first feed amount coincides with said second feed amount, when a difference between said first and second feed amount is more than a predetermined tolerance.

An ensuring apparatus for performing this method can include driving device for driving a feed roller which feeds a plurality of wires; detecting device for detecting a first feed amount which the wires is actually fed; and controlling device for controlling said driving means so that the first feed amount coincides with a second feed amount given as an instruction to said feed roller so as to feed by a predetermined length. The control means compares said first feed amount with said second feed amount, and rotates said driving means for said feed roller when a difference between said first feed amount and said second feed amount is more than a predetermined tolerance, to thereby perform a feedback control.

By effecting this feedback control, a variation in the feed amount due to a variation in the rate of slip between the feed roller and the wire and a variation in the diameter of the wires is corrected, and therefore the wires can be fed in a proper amount to a terminal portion of a connector, and the press-connection of the wires can be effected positively. And besides, when fitting a lid on the connector, the wires will not be extended outwardly from the connector (connector housing), and therefore the lid can be positively fitted thereon.

There is provided a mechanism for detecting an amount of travel of wires traveling in a juxtaposed manner, wherein length-measuring rollers are provided respectively for the juxtaposed wires, and are arranged in a staggered manner in a direction of juxtaposition of the wires (which is a vertical direction with respect to a longitudinal direction of the wire), and a number of revolutions of each of the length-measuring rollers is detected by an encoder, thereby detecting the amount of travel of each wire. By arranging the length-measuring rollers in a staggered manner, the length-measuring rollers can be provided respectively for the wires even if the dimension of the length-measuring rollers in the direction of juxtaposition of the wires is larger than the pitch of the wires, and the wires can be arranged at the predetermined pitch.

DETAILED DESCRIPTION OF THE PREFERRED EMBODIMENTS

Figure 1:
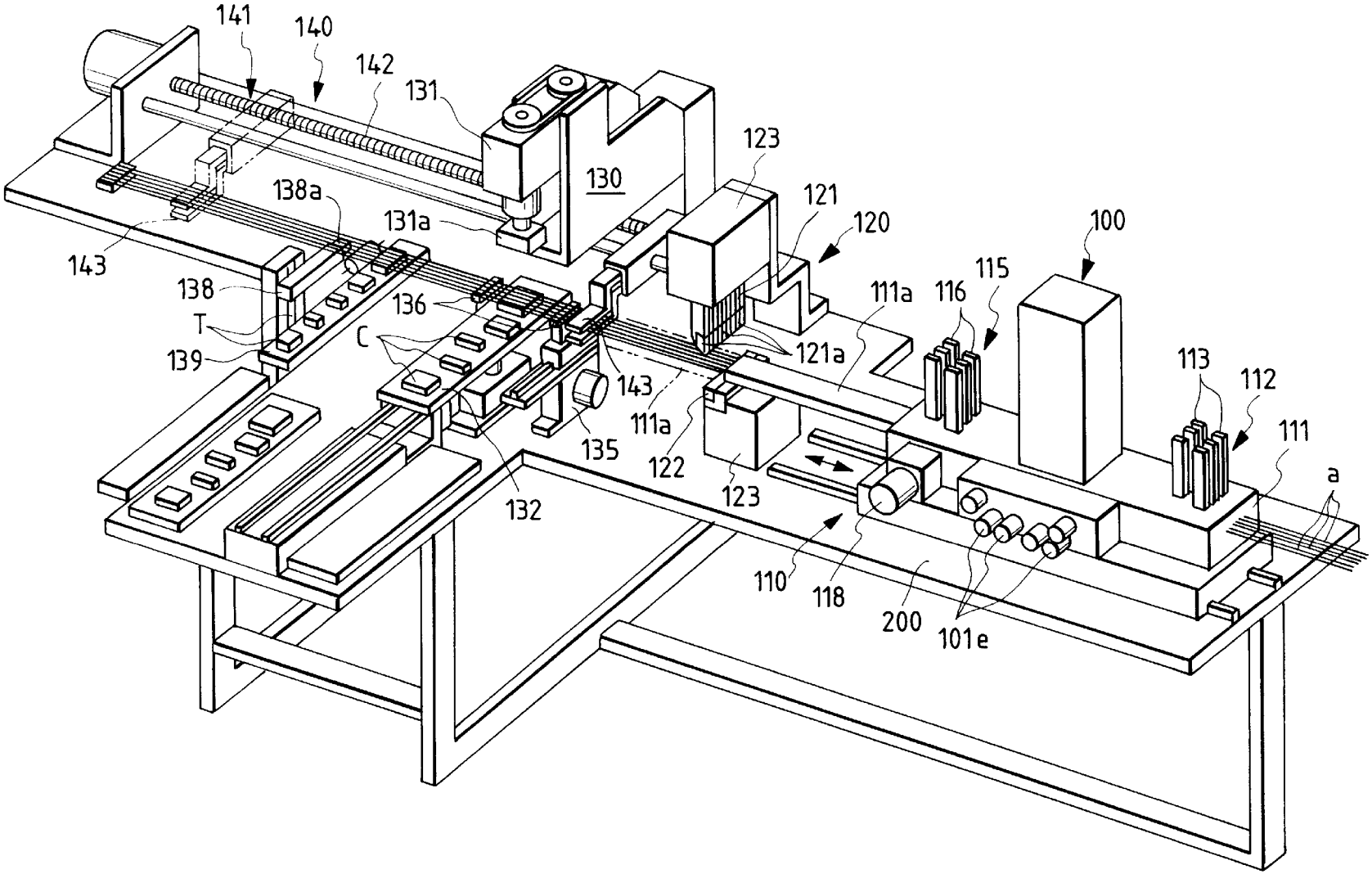
FIG. 1 is a perspective view showing an overall construction of a first embodiment.

Preferred embodiments of the present invention will be described with reference to the drawings, and those portions identical to those of the conventional construction will be designated by identical reference numerals, respectively, and explanation thereof will be omitted.

First Embodiment

First, the whole of a wire harness-producing apparatus, incorporating a wire feed amount-ensuring apparatus of the present invention, are shown in FIGS. 1 to 4, and to avoid the complicacy of illustration, there will be shown an arrangement in which six wires are fed in a juxtaposed manner.

As shown in FIG. 1, this wire harness-producing apparatus includes a wire holding zone 110 for holding the wires a, a wire cutting zone 120 for cutting the wires a, a connector mounting zone 130 for mounting a connector C, and a length-adjusting/drawing zone 140 for adjusting a feed length of the wires a and for drawing out the wires a, and these zones are provided on a bed 200.

Figure 2:
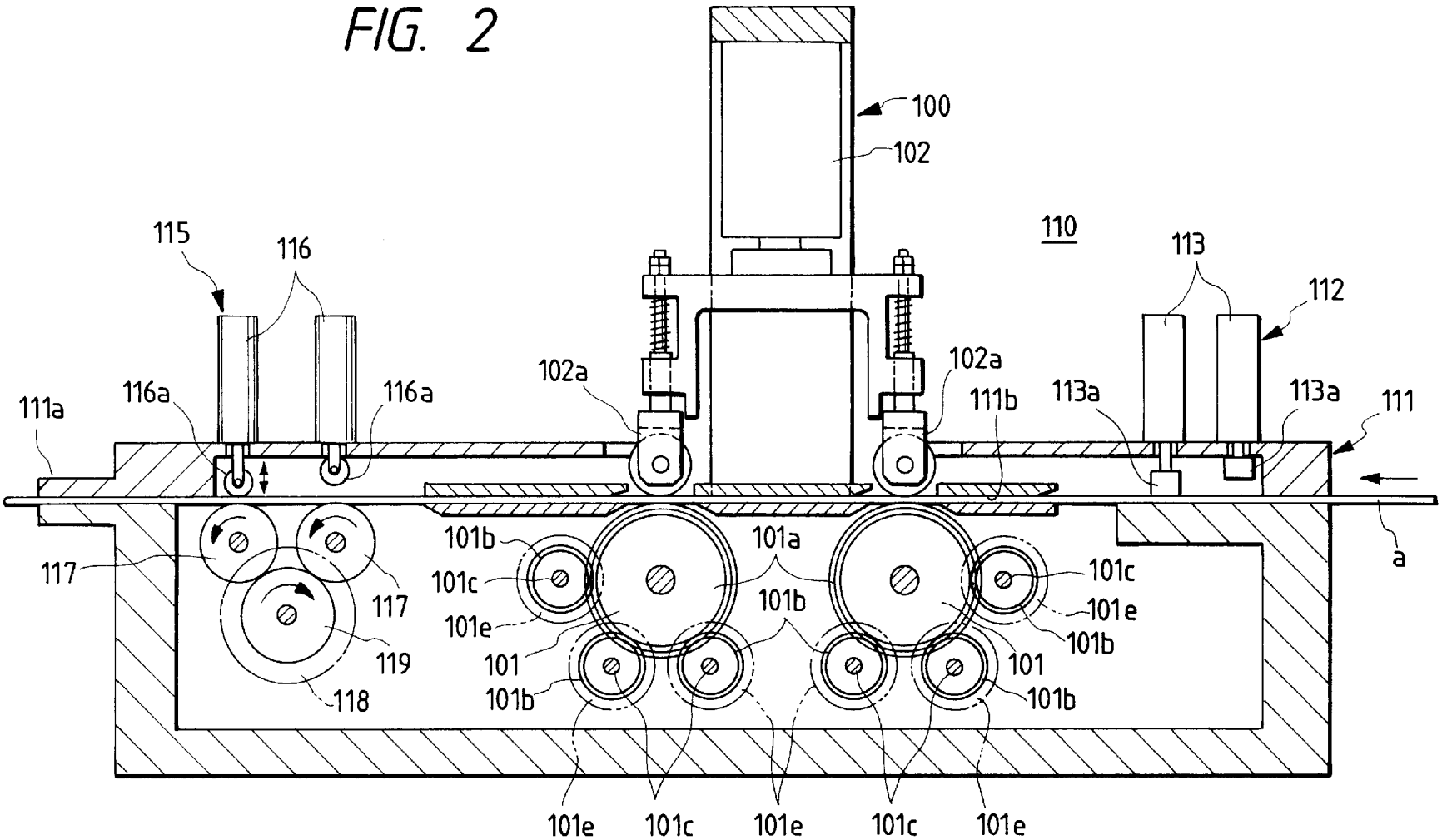
FIG. 2 is a cross-sectional view showing a wire feed amount-ensuring apparatus incorporated in the above embodiment.

As shown in FIGS. 1 and 2, the wire holding zone 110 comprises a groove guide 111 having an arm portion 111*a* at its front end, a grip 112 and a wire feed device 115 each for pressing the wires a passing through the groove guide 111, and the wire feed amount-ensuring apparatus 100 of the present invention.

The groove guide 111 comprises a flat member split into two (upper and lower) portions, and grooves 111*b* are formed between the two portions, and extend over an entire length thereof, and the pitch of the grooves 111*b* corresponds to the pitch of terminals juxtaposed in the connector C. The insulating sheathed wires a are fed from a wire supply device (not shown) respectively into the grooves 111*b* in such a manner that the twisting of these wires is corrected. The groove guide 111 is moved forward and backward by an air cylinder (not shown), and its arm portion 111*a* extends to the wire cutting zone 120 as indicated in phantom in FIG. 1.

As shown in FIGS. 1 and 2, the grip 112 comprises three front-side (downstream side in a direction of feed of the wires) air cylinders 113 and three rear-side (upstream side in the wire feed direction) air cylinders 113, and press members 113*a* mounted respectively on lower ends of these air cylinders 113. When the air cylinders 113 are operated, the press members 113*a*, mounted respectively on the lower ends thereof, are pressed respectively against the wires a, received respectively in the grooves 111*b*, to prevent the movement of these wires (see the condition of the front-side air cylinders 113 in FIG. 2). When the press members 113*a* are raised (see the condition of the rear-side air cylinders 113 in FIG. 2), the wires a can move in the respective grooves 111*b*, but can not move quite easily because of the resistance offered by the grooves 111*b*.

The two (front and rear) rows of air cylinders 113 are arranged in a staggered manner in a direction of the width because the diameter of the air cylinders 113 is larger than the pitch (spacing) of the wires a, and the six air cylinders 113 can not be arranged in a row in the direction of the width.

As shown in FIGS. 1 and 2, the wire feed device 115 includes two feed rollers 117 disposed on the lower side of the wires a to guide all of these wires a, and grooves 117*a*, corresponding respectively to paths of feed of these wires a, are formed in a peripheral surface of each feed roller 117, and the wires a are fitted at their lower portions in these grooves 117*a*, respectively, and therefore will not be displaced in the direction of the row of the wires.

On the upper side of the wires a, three front-side and three rear-side press rollers 116*a*, corresponding respectively to the wires a, are mounted in a staggered manner respectively on air cylinders 116 so as to move upward and downward, and when each press roller 116*a* is moved downward a predetermined amount, it cooperates with the lower-side feed roller 117 to hold the associated wire a therebetween. The press rollers 116*a* are arranged in a staggered manner for the same reason as described above for the arrangement of the air cylinders 113 for the press members 113*a* of the grip 112.

When the air cylinders 116 (see the front-side air cylinders 116 in FIG. 2) are operated, the press rollers 116*a*, mounted respectively on lower ends thereof, are moved downward to be pressed against the feed roller 117, and therefore the wires a are fed by the rotation of this feed roller 117. This feed amount adjusts to the drawing amount in the length-adjusting/drawing zone 140 as described later.

The feed rollers 117 are rotated by a servo motor M of a drive device 118 through an idler 119, and when feeding the wires a, the wires a are pressed respectively by the upper-side press rollers 116*a*, and the feed length of the wires is adjusted by a method in which the revolution number and position of each feed roller 117 are detected by a rotary encoder E mounted on the servo motor M, and these detection values are transmitted to a servo amplifier Am, and an instruction indicative of the feed amount is fed from the servo amplifier Am to the servo motor M.

Thus, in the wire holding zone 110, by selectively operating the air cylinders 113 and 116, desired ones of the wires a can be fed while holding the other wires against movement.

Further, a wire feed amount-ensuring apparatus 100 of the present invention feeds wires a so that a variation is suppressed within a predetermined tolerance. This wire feed amount-ensuring apparatus 100 is described later.

As shown in FIG. 1, the wire cutting zone 120 includes an upper cutter 121, a lower cutter 122, and air cylinders 123 for moving the two cutters 121 and 122 upward and downward. The upper cutter 121 includes blades 121*a* corresponding in number to the wires a, and the air cylinders 123 correspond in number to the blades 121*a*, and three of the air cylinders 123 are provided at a front side while the other three are provided at a rear side. The blades 121*a* can be moved upward and downward independently of each other, and therefore the wires a, fed through the grooves guide 111, can be arbitrarily cut independently of each other. The rear-side air cylinders 123 move the blades 121*a* through a link mechanism.

Figure 3:
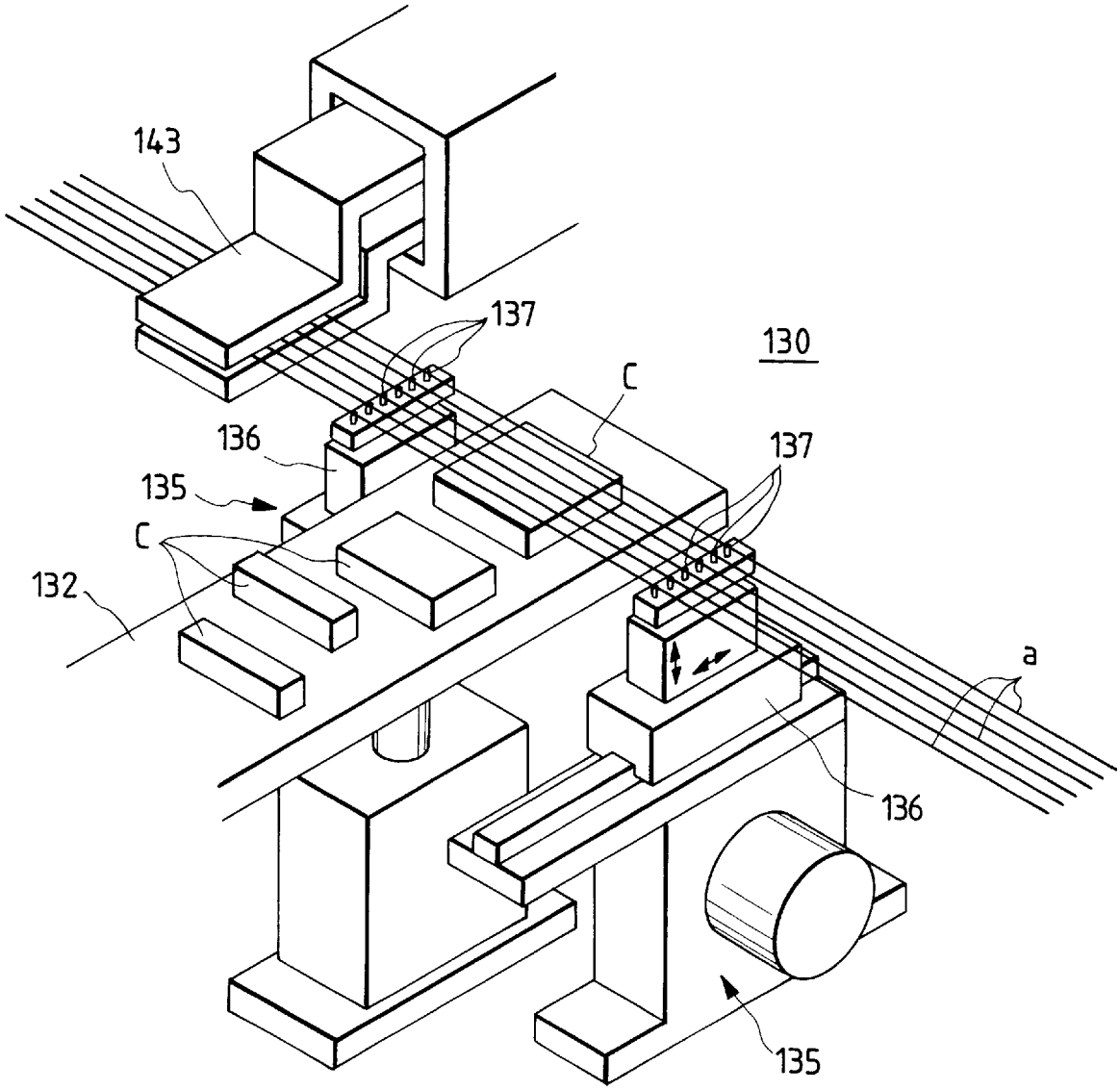
FIG. 3 is a schematic perspective view showing a wire shifting portion of the first embodiment.
Figure 4:
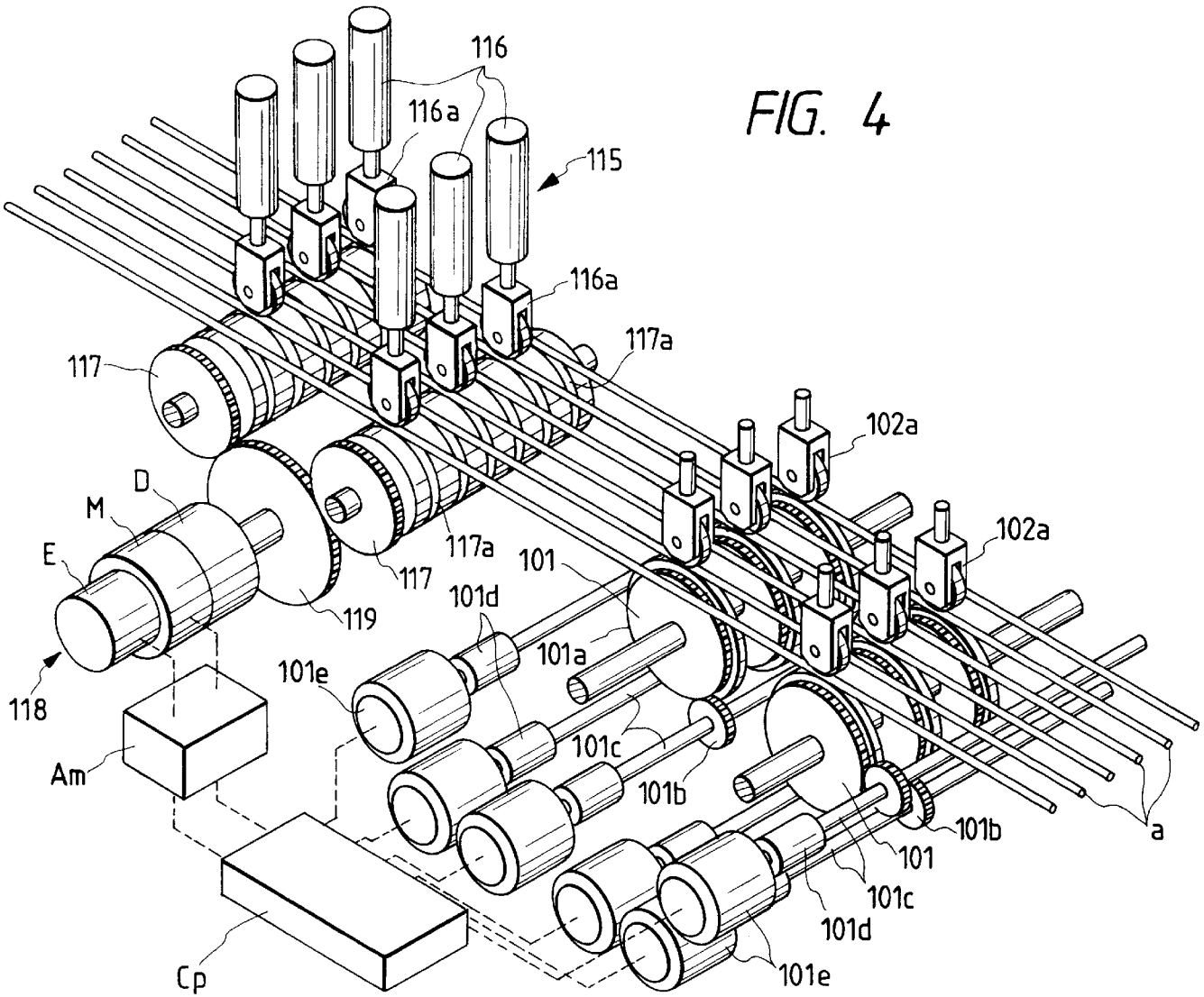
FIG. 4 is a perspective view showing a wire feed machine and the wire feed amount-ensuring apparatus associated therewith.

As shown in FIGS. 1 and 3, the connector mounting (press-connecting) zone 130 includes a press-connection pressing machine 131, a supply bed 132 for supplying the connectors C, wire shifting machines 135, a wire drawing device 138, and a supply bed 139 for supplying covers T. The press-connection pressing machine 131 includes a press-connecting member 131*a* which is moved upward and downward so as to press-fit the wires a respectively into the terminals of the connector C, disposed at a press-connecting position, thereby connecting these wires to the respective terminals. In FIGS. 1 and 3, although the connector C is manually supplied to the press-connecting position, this can be effected by an automatic supply machine. Various kinds of press-connecting members 131*a* are prepared, and the press-connecting member 131*a* can be automatically exchanged with another in accordance with the kind of connector C to be used.

As shown in FIG. 3, the wire shifting machines 135 are provided respectively on opposite sides of the connector supply bed 132, and includes a jig 136 which is movable upward, downward, right and left, and has shifting pins 137 formed on an upper surface thereof. The jig 136 is moved upward and downward by an air cylinder (not shown), and is normally retracted to a position beneath the path of travel of the wires a so that the jig 136 will not prevent the travel of the wires a. When shifting the wires a, the jigs 136 are moved right, left and upward, and the pins 137 are brought into engagement with the wires a so as to shift the wires a. More specifically, the jig 136 of each of the wire shifting machines 135 is movable upward, downward, right and left as indicated by arrows in FIG. 3, and the jig 136 is positioned beneath the wires a to be shifted, and then is moved upward, so that each wire a is held between the associated pins 137, and then the jig 136 is moved right and left to shift the wires a.

As shown in FIG. 1, the wire drawing device 138 is movable upward and downward, and includes a vertically-movable grip claw 138*a* for gripping a desired one of the wires a, and when the wire drawing device 138 is moved downward, with the desired wire a gripped by the grip claw 138*a*, this wire a is drawn from the grip 112 (i.e., the groove guide 111) longer than the other wires a. At this time, the grip 112 for this wire a to be drawn is released (i.e., the air cylinder 113 is moved upward), and the wire feed device 115 (i.e., the press roller 116*a*) effects a feeding operation.

Various kinds of covers T, corresponding respectively to the various kinds of connectors C, are sequentially arranged on the cover supply bed 139, and the cover T is manually fitted on the connector C. This fitting operation can be effected by an automatic machine.

The length-adjusting/drawing zone 140 includes a length-adjusting/drawing machine 141, and a chuck 143 for the wires a is threaded on a screw shaft 142, and the wires a are clamped by this chuck 143, and the screw thread 142 is rotated a required number of times by a motor (not shown) to move the chuck 143 with a predetermined distance, thereby drawing the wires a by a predetermined length from the grip (i.e., the groove guide 111). Namely, by adjusting this drawing amount, the length-adjusting operation is effected by adjusting the drawing amount, and the wires are cut into a predetermined length by the cutting machine (cutters 121 and 122). When effecting this drawing operation, the grip 112 corresponding to the wire a to be drawn, is released (i.e., the air cylinder 113 is moved upward), and the wire feed device 115 (i.e., the press roller 116*a*) effects a feeding operation.

The foregoing is the overall construction and operation of the wire harness-producing apparatus of the present invention. Next, the wire feed amount-ensuring apparatus 100 (hereinafter often referred to as "ensuring apparatus"), which is a main feature of the invention with reference to FIG. 4.

As described above, the ensuring apparatus 100 is provided between the grip 112 and the wire feed device 115 of the wire holding zone 110, and controls the feeding operation of the feed device 115 so as to keep a variation in the amount of feed of the wires a to within the range of a tolerance, thereby enhancing the feed precision.

The ensuring apparatus 100 includes six length-measuring rollers 101 which are provided on the lower side of the wires a and correspond respectively to the wires a, and six press rollers 102*a* which are provided on the upper side of the wires a and correspond respectively to the wires a. The press rollers 102*a* are mounted respectively on air cylinders 102, and can be moved upward and downward. Each press roller 102*a*, when moved downward, cooperate with the associated length-measuring roller 101 to hold the associated wire a therebetween. Each of the group of length-measuring rollers 101, the group of press rollers 102*a* and the group of air cylinders 102 are arranged in such a staggered manner that three of each group are disposed at the front side while the other three are disposed at the rear side, as described above for the arrangement of the grip 112 and the wire feed device 115.

A gear 101*a* is mounted on each length-measuring roller 101 in coaxial relation thereto, and a rotary encoder 101*e* is connected via a coupling 101*d* to a shaft 101*c* supporting a gear 101*b* in mesh with the gear 101*a*. Each rotary encoder 101*e* detects the revolution number of the associated length-measuring roller 101, and detects the amount of actual feed of the wire a in accordance with this revolution number, and feeds a pulse signal, representing its detection value, to a comparison processing portion Cp of a controller (not shown).

The comparison processing portion Cp compares the actual feed amount, detected by each rotary encoder 101*e*, with a predetermined feed amount of the feed roller 117 beforehand given from the comparison processing portion Cp as a feed instruction pulse value to a servo motor for driving said feed roller. If there is the difference between the two, the comparison processing portion Cp sends a correction instruction pulse value to a position control amplifier for the servo amplifier Am of the wire feed device 115, and the servo amplifier Am sends an instruction to the servo motor M of the feed roller 117 so as to rotate this feed roller 117 by an amount, corresponding to the difference, in a normal or a reverse direction.

By thus effecting this feedback control, a variation in the feed amount due to a variation in the rate of slip between the feed roller 117 and the wire a and a variation in the diameter of the wires a is corrected, and therefore the wires a can be fed in a proper amount to the terminal portion of the connector C, and the press-connection of the wires can be effected positively. And besides, when fitting the lid T on the connector C, the wires a will not be extended outwardly from the connector (connector housing) C, and therefore the lid T can be positively fitted thereon.

In this feedback control, when a variation of the feed amount is encountered with two or more of the wires a, these wires are corrected in the feed amount independently of each other, and at this time the press roller 116*a*, disposed above the feed roller 117, is moved vertically into contact with the wire a to be corrected, and then the servo motor is driven to make a correction.

Second Embodiments

A second embodiment is directed to a press-connection/wire installation robot R (see FIG. 5) having a wire feed amount-ensuring apparatus 100 of the invention incorporated therein.

Figure 5:
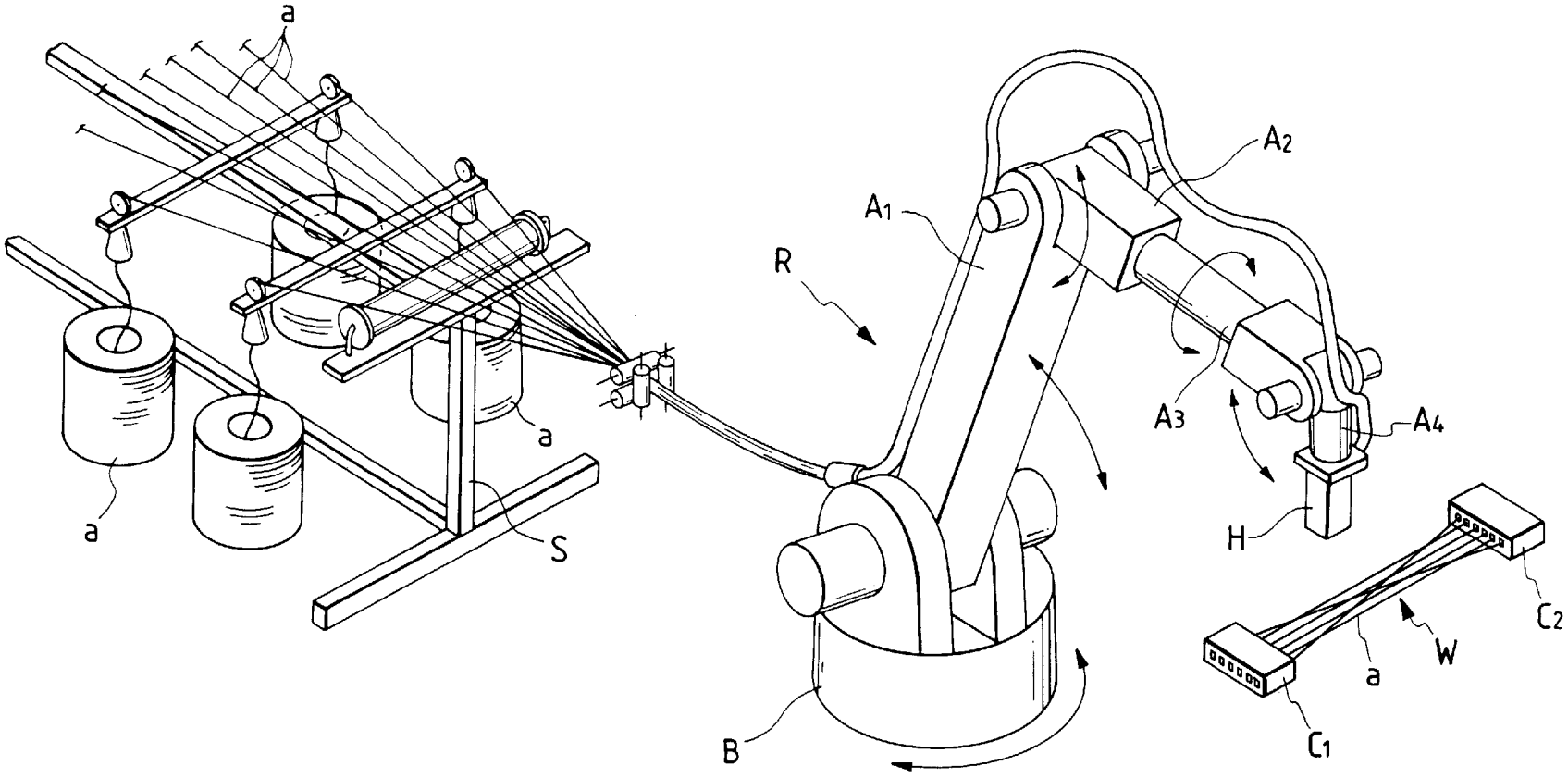
FIG. 5 is a perspective view showing an overall construction of a second embodiment.

In this robot R, a base B and arms $A_1$, $A_2$, $A_3$ and $A_4$, mounted on the base B, are rotatably or angularly movable as 20 indicated by arrows in FIG. 5 so that a head portion H, provided at a distal end of this robot is movable in a three-dimensional manner. Wires a, supplied from a wire supply stand S, are fed from the head portion H so that the press-connection and installation of the wires can be effected. The ensuring apparatus 100 is incorporated in the head portion H, and FIGS. 6 to 9 show the head portion H in detail. In an example described below, although ten (10) wires a are fed from the head portion H, this is merely one example, and the number of the wires is not limited to ten.

Figure 6:
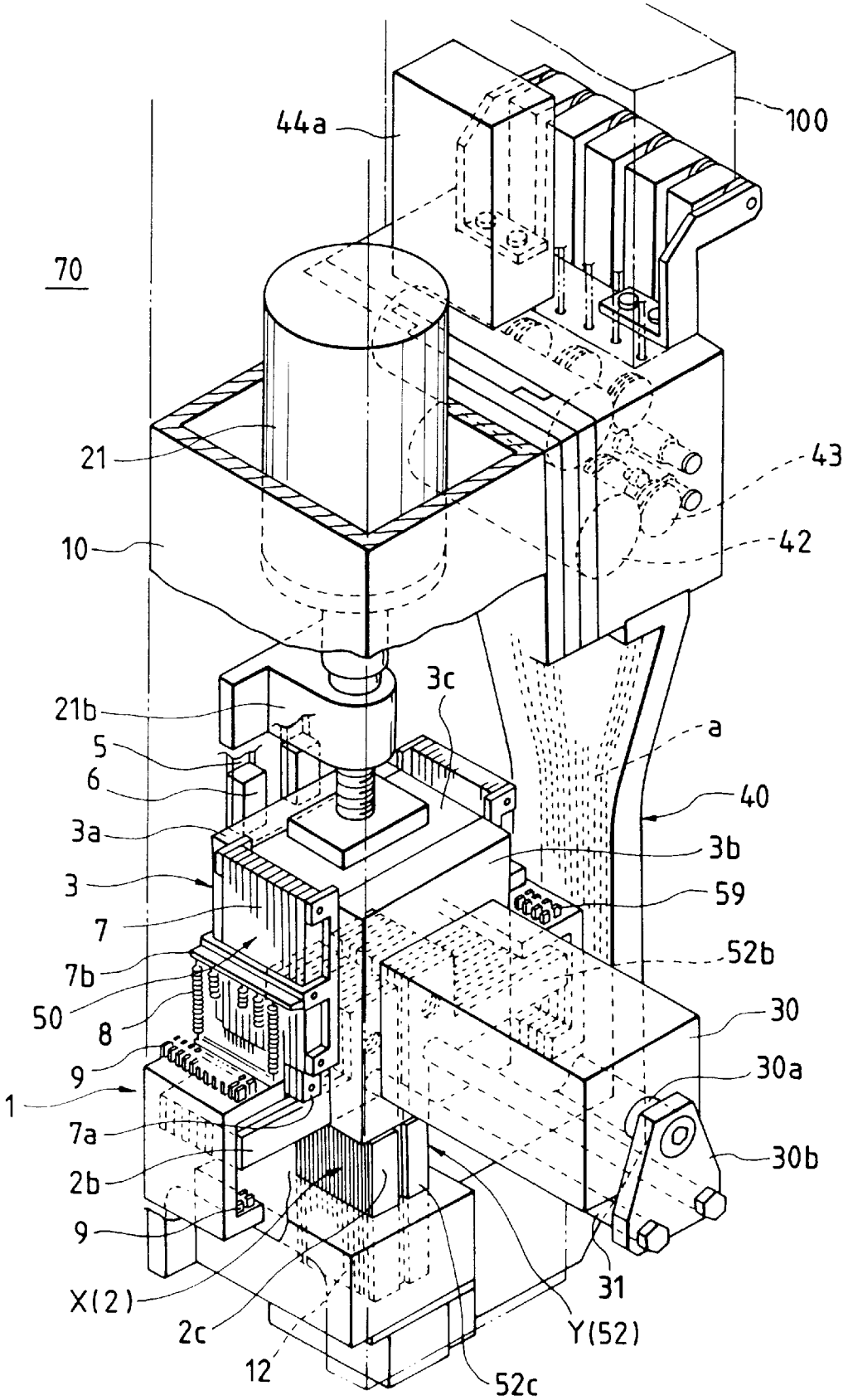
FIG. 6 is a perspective view of a head portion of the second embodiment.

As shown in FIG. 6, the head portion H includes a press-connecting portion 1 provided within a tubular base frame 10 of a rectangular cross-section, and a wire supply portion 70 provided on one side surface of the base frame 10, and the ensuring apparatus 100 is incorporated in this wire supply portion 70.

The press-connecting portion 1 includes a group X of five pressure blades 2 operable independently of each other, a group Y of five press-connecting blades 52 operable independently of each other, and a pressure blade selecting mechanism 50 by which a desired one of the group X of pressure blades 2 and a desired one of the group Y of pressure blades 52 can be operated. The press-connecting portion 1 is vertically moved relative to the terminals of the connector C by an elevating block 3.

The elevating block 3 is formed into a C-shaped rectangular frame by the two opposed side plates 3*a*, 3*b* and the upper plate 3*c*. Between the two opposed side plates 3*a*, 3*b*, the sets X, Y each of the five pressure-blades 2, 52 are arranged.

Figure 7:
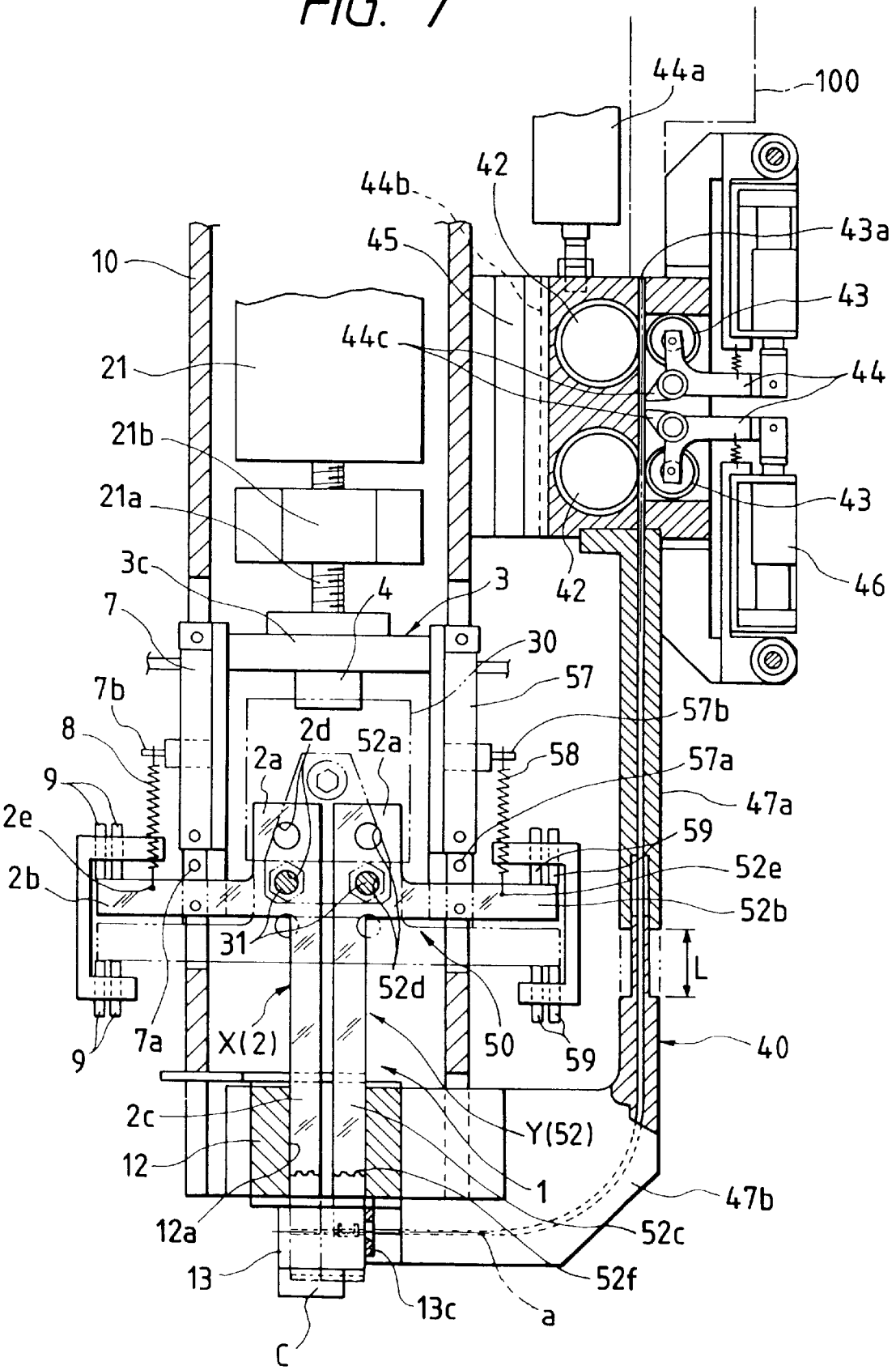
FIG. 7 a partly cross-sectional, side-elevational view of the head portion.
Figure 8:
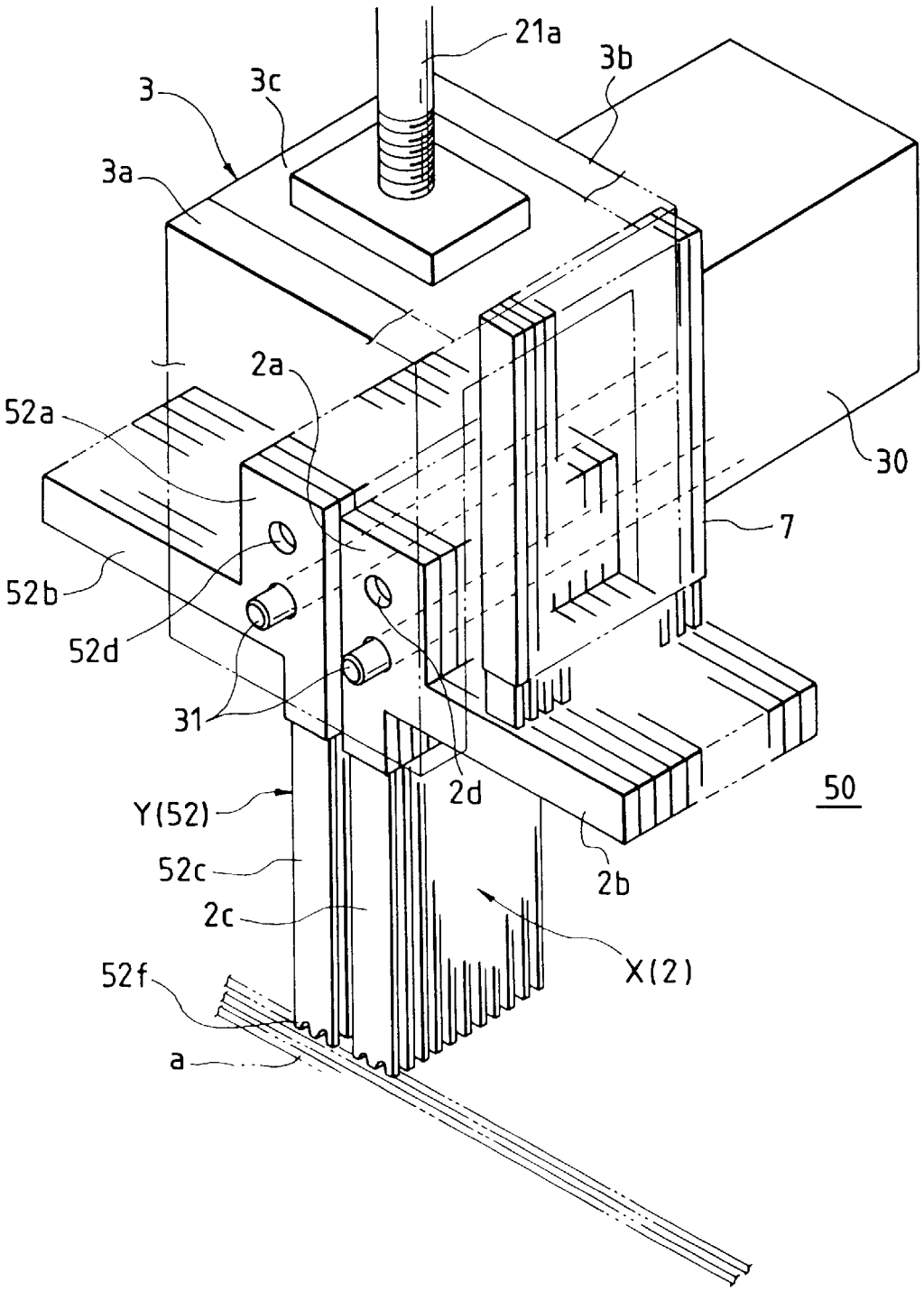
FIG. 8 is a perspective view of an important portion of the second embodiment.

As illustrated in FIGS. 6 to 8, on the upper plate 3*c* of the elevating block 3, there is provided a ball nut 4. Into this ball nut 4, a rotational shaft 21*a* of the servo motor 21 attached to the frame 10 is screwed via a bearing 21*b*. Therefore, when the rotational shaft 21*a* is rotated, the elevating block 3 can be elevated. On the outer surface of one side plate 3*a* of the elevating block 3, there are provided two guide grooves 5, 5 which are arranged in the vertical direction. In the frame 10, there are provided two guide rails 6, 6 which engage with these grooves 5, 5. The elevating block 3 is elevated along these guide rails 6, 6.

Next, the arrangement and action of the pressure-blades 2, 52 and the selecting mechanism 50 will be explained below.

As shown in FIGS. 7 and 8, the pressure-blades 2, 52 are composed of plate-shaped bodies having L-shaped sections 2*a*, 52*a* and also composed of belt-shaped blade bodies 2*c*, 52*c* soldered to the L-shaped sections 2*a*, 52*a*. The thus formed pressure-blades 2, 52 are arranged between the side plates 3*a* and 3*b* of the elevating block 3 in such a manner that the surfaces of the pressure-blades 2, 52 are set in parallel with the surfaces of both side plates 3*a*, 3*b*, and the numbers of the pressure-blades 2, 52 are the same (that is, 10 pieces) as those of the pressure-terminals of the connectors.

The L-shaped sections 2*a*, 52*a* of the pressure-blades 2, 52 are arranged along the surfaces of the side plates 3*a*, 3*b* symmetrically with respect to the transverse direction. In the vertical sections of the L-shaped section 2*a*, 52*a*, there are provided two insertion holes 2*d*, 52*d* for each vertical section, and the following selecting bars are inserted into these insertion holes 2*d*, 52*d*.

As illustrated in FIGS. 7 and 8, on the upper edge sides of the L-shaped horizontal sections 2*b*, 52*b* of the pressure-blades 2, 52, there are provided air cylinders 7, 57, and these air cylinders correspond to the pressure-blades by one-to-one. Reference numeral 57 is omitted in FIG. 8. In the middle sections of the air cylinders 7, 57, there are provided engaging protrusions 7*b*, 57*b*. Between these engaging protrusions 7*b*, 57*b* and the engaging holes 2*e*, 52*e* provided in the L-shaped horizontal sections 2*b*, 52*b*, there are provided springs 8, 58, so that the pressure-blades 2, 52 are pushed upward at all times. The L-shaped horizontal sections 2*b*, 52*b* are pushed downward by the rods 7*a*, 57*a* of the cylinders 7, 57 against the spring forces, so that the pressure-blades 2, 52 can be positioned at specific vertical positions.

On the outer surface of the side plate 3*b* of the elevating block 3, as illustrated in FIGS. 6 and 8, there is provided an air cylinder 30 which is attached perpendicular to the side plate 3*b*. At the end of the rod 30*a* of the air cylinder 30, there are provided two selecting bars 31, 31, and also there are provided a plate-shaped selecting bar holder 30*b* attached perpendicular to the plate surface.

The selecting bars 31 function as follows. The L-shaped horizontal sections 2*b*, 52*b* of the desired pressure-blades 2, 52 in the sets X and Y of the pressure-blades 2, 52 are pushed downward by the rods 7*a*, 57*a* of the cylinders 7, 57. After that, the pushed L-shaped horizontal sections 2*b*, 52*b* are fixed by the selecting bars 31. In this state, the thus pushed L-shaped horizontal sections 2*b*, 52*b* are protruded from the lower ends of the residual pressure-blades 2, 52.

In order to make the desired pressure-blades 2, 52 protrude from the lower ends of the residual pressure-blades 2, 52 and fix them in the state, the pressure-blades 2, 52 are pushed downward by the cylinders 7, 57 until the centers of the upper side holes of the insertion holes 2*d*, 52*d* in the L-shaped vertical sections coincide with the axial centers of the selecting bars 31. In the above state, the above cylinders 30 are operated, and the selecting bars 31 are inserted into the upper side insertion holes 2*d*, 52*d*.

In this connection, as illustrated in FIGS. 6 and 7, in order to make certain the vertical positions of the pressure-blades 2, 52, there are provided electromagnetic sensors 9, 59 to detect the elevation of the pressure-blades 2, 52, on the vertical lines which pass through the end portions of the L-shaped horizontal sections 2*b*, 52*b* protruding from the side of the elevating block 3.

As described above, the desired pressure-blades 2, 5 are protruded from the lower ends of other pressure-blades 2, 52 and fixed in the state. When the pressure-blades in the above state are lowered by the elevating blocks 3, 3, only the protruding pressure-blades 2, 52 are inserted into the grooves of the pressure-terminals. Accordingly, only the wires a fed to the positions of the pressure-blades 2, 52 are connected to the connectors with pressure.

As illustrated in FIGS. 6 and 7, the lower end portions of the belt-shaped blade bodies 2*c*, 52*c* are gently inserted into the guide holes 12*a* of the guide blocks 12. Therefore, as described later, when the pressure-blades 2, 52 are elevated by the elevating block 3, the side formed by a bundle of the pressure-blades 2 of the set X and the side formed by a bundle of the pressure blades 52 of the set Y slide along the inner surface of the guide holes 12*a*, so that the pressure blades 2, 52 can be smoothly elevated. This guide block 12 (which is omitted in FIG. 8) is fixed to the frame 10 by bolts.

A side end section of the belt-shaped section 52*c* of the pressure-blade 52 of the set Y on the side of the electrical wire feed section 70 is a cutting blade 52*f* to cut the wires a. The lower blade 13*c* corresponding to the cutting blade 52*f* is arranged in the guide block 13, as shown in FIG. 7. When the pressure-blade 52 is lowered, the wires a are cut by the lower blade 13*c* in cooperation with the cutting blade 52*f*.

The shapes of the cutting blades 2, 52 and the arrangement and action of the selecting mechanism 50 are described above. In order for the selecting mechanism 50 to be operated properly, the following precondition is required. When the selecting bar 31 is inserted into the lower insertion hole, which is one of the two insertion holes 2*d*, 52*d* formed in the L-shaped vertical sections of the pressure-blades 2, 52, that is, when the pressure-blades 2, 52 are located at the upper dead points, it is important that the lower dead points are located at the position of the elevating block 3 so that the pressure-blades 2, 52 can not be inserted into the grooves of the pressure terminals even if the elevating block 3 is lowered.

Next, the wire supply portion 70, incorporating the wire feed amount-ensuring apparatus 100, will be described with reference to FIGS. 6, 7 and 9.

The wire supply portion 70 includes the wire feed amount-ensuring apparatus 100, a wire feed portion 40, and wire guides 47*a* and 47*b*.

The wire feed portion 40 includes a pair of rotary rollers 42 (see FIG. 7) which are rotated by a motor 41 through gears 41*a*, and feed rollers 43 movable into and out of contact with the rollers 42. The pair of rotary rollers 42 are rotated in the same direction at the same speed by the gears 41*a* (see FIG. 7). The motor 41, the rollers 42 and 43 and so on are mounted on a moving block 45, and this moving block 45 is moved upward and downward a guide 44*b* by an air cylinder 44*a*.

The feed rollers 43 are arranged in two (upper and lower) rows in a direction of the width (in a right-left direction in FIG. 9), and are arranged in a staggered manner so that the adjacent rollers 43 will not interfere with each other. The wire a from each introduction hole 43*a* is introduced between each feed roller 43 and the rotary roller 42, and the two rollers 42 and 43, pressed against each other, rotate, with the wire a held therebetween, so that the wire a is fed downward.

As shown in FIG. 7, the feed rollers 43 are mounted on one ends of Y-shaped links 44, and the other ends 44*c* of the links 44 serve as press portions. The proximal end of each link 44 is connected to a rod of an air cylinder 46, and when the rod is extended, the feed roller 43 is pressed against the rotary roller 42, and when the rod is retracted, the feed roller 43 is moved out of contact with the rotary roller 42, whereby the press portion 44*c* presses against the wire a.

Figure 9:
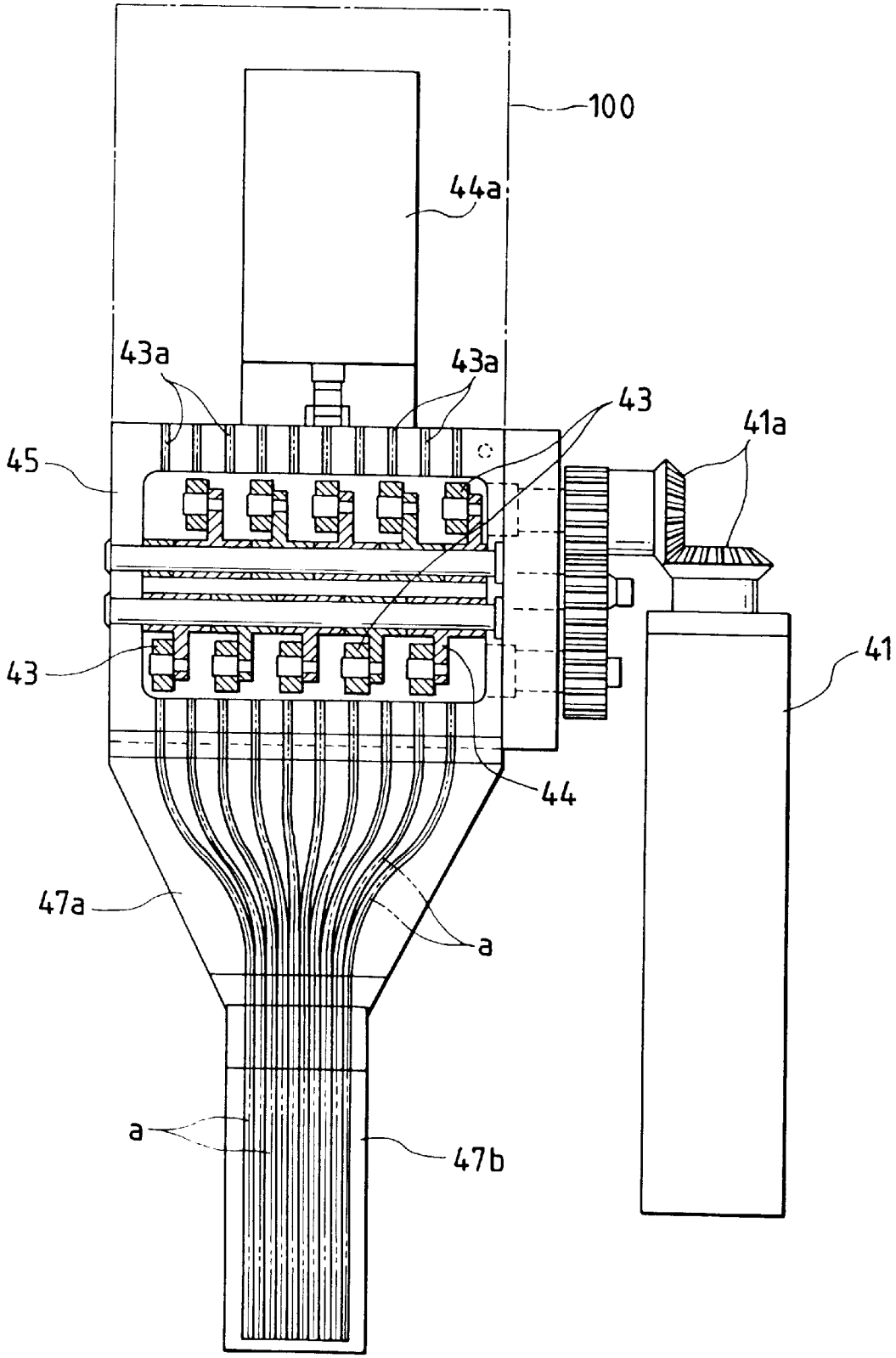
FIG. 9 is a perspective view of an important portion of the second embodiment.
Figure 10:
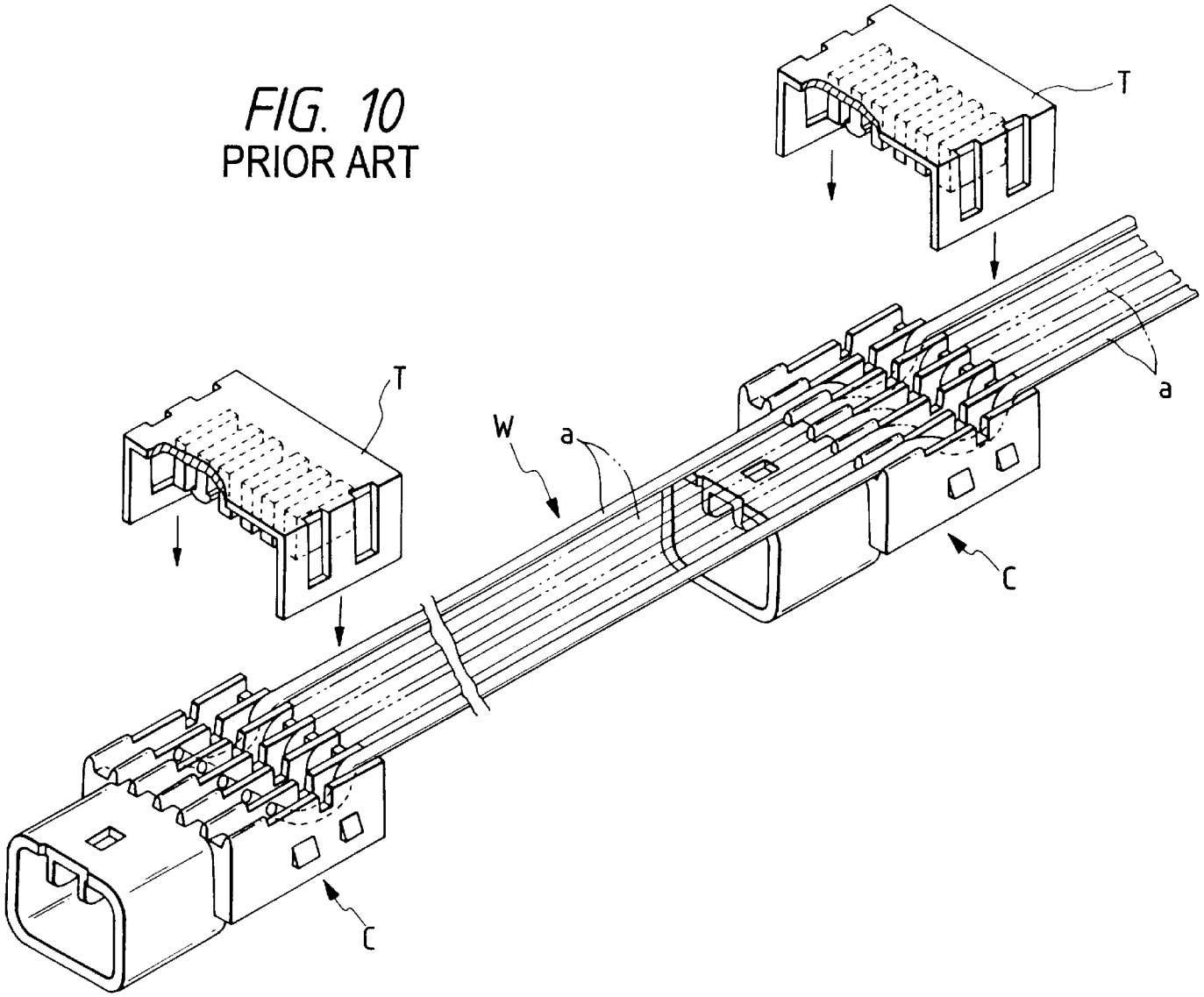
FIG. 10 PRIOR ART
FIG. 10 is a perspective view showing one example of a wire harness.
Figure 11:
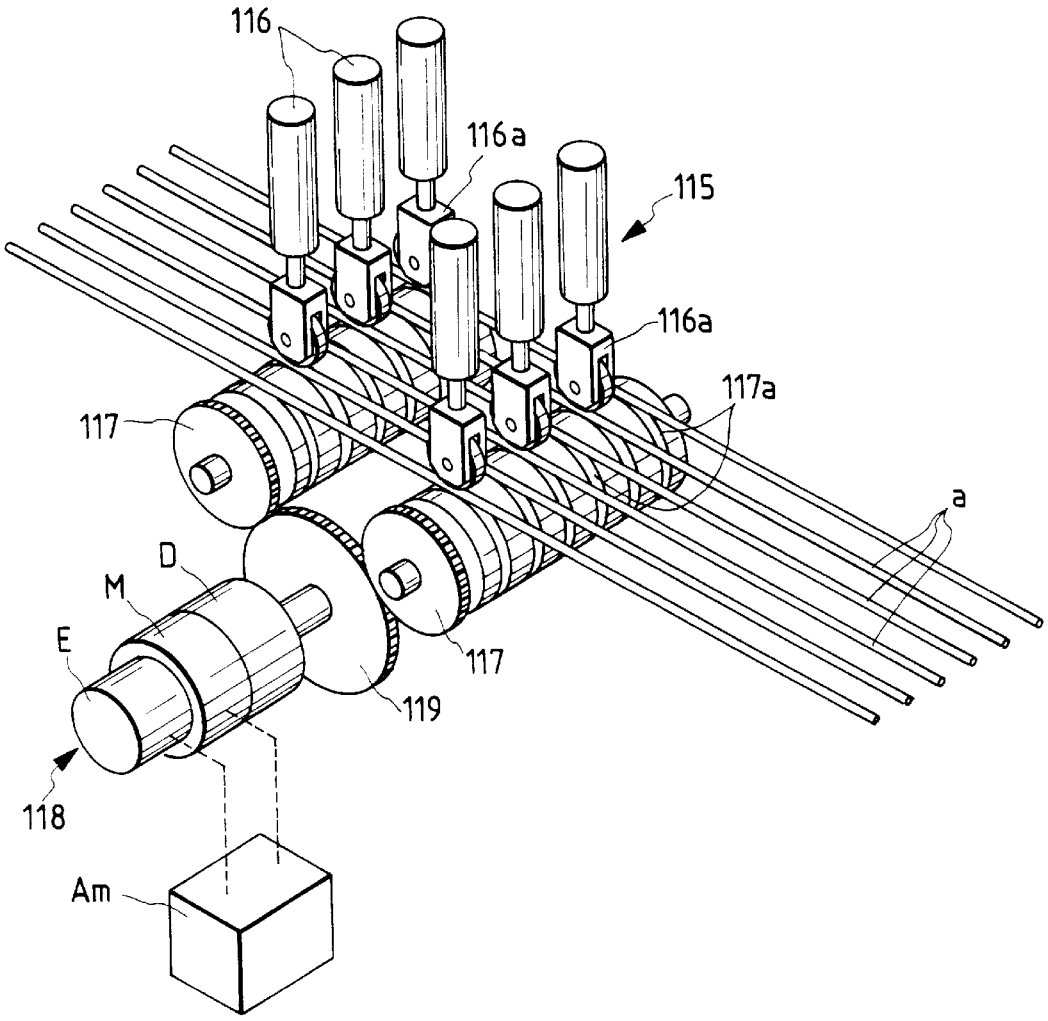
FIG. 11 PRIOR ART
FIG. 11 is a perspective view of a conventional wire feed apparatus.

The wire feed amount-ensuring apparatus 100 of the second embodiment is provided adjacent to the wire introduction holes 43*a* of the wire feed portion 40, as indicated by a dot-and-dash line in FIGS. 6, 7 and 9, and feed the wires a between the rotary rollers 42 and the feed rollers 43. The ensuring apparatus 100 is similar in construction and operation to the wire holding portion 110 of the wire harness-producing apparatus of the first embodiment, and therefore a detailed illustration thereof is omitted here, and a region where it is mounted is merely indicated by the dot-and-dash line.

In this case, also, by length-measuring rollers and encoders in the ensuring apparatus 100, the amount of actual feed of the wires a in the wire feed portion 40 is detected in terms of the revolution number of the rotary rollers 42, and a feedback control, similar to that of the first embodiment, is performed. Therefore, the wires a can be fed in an accurate amount within the range of a tolerance to the wire guides 47*a* and 47*b*.

The wire guide 47*a* is provided at the lower surface of the moving block 45, and the wires a, passed between the rotary rollers 42 and the feed rollers 43, pass through the wire guide 47*a*, and are directed to the press-connecting portion 1.

The other wire guide 47*b* is provided at the front side of the base frame 10 at a lower end thereof, and a wire supply pipe portion of the wire guide 47*a* is movably fitted in the guide 47*b*.

As shown in FIG. 7, when the air cylinder 44*a* of the wire feed portion 40 is extended to lower the block 45 by a distance L, the wires a are projected from a lower blade 13*c* by a length corresponding to this distance L, and when the pressure blades 2 are lowered, the wires a are pressed down, and are press-connected to respective press-connecting terminals of the connector.

The foregoing is the constructions and operations of the press-connecting portion 1, wire supply portion 70 and pressure blade selecting mechanism 50 which constitute the head portion H of the press-connection/wire installation robot R of this embodiment.

With the use of the press-connection/wire installation robot R, desired ones (2 and 52) can be selected from the pressure blades 2 and 52 by the pressure blade selecting mechanism 50, and the press-connecting operation is effected only by the selected pressure blades 2 and 52. Therefore, when producing a wire harness W of a cross-wiring design as shown in FIG. 5, the wires a are press-connected at one time to one connector $C_1$, and then the installation operation (horizontal movement toward the other connector $C_2$) is effected only once, and thereafter, for press-connecting the wires to the other connector $C_2$, it is only necessary to move the head portion H in a direction of juxtaposition of the press-connecting terminals of the connector $C_2$. Thus, the wire installation operation can be effected much more easily than the conventional method in which the returning to the one connector $C_1$ is required each time the wire is press-connected to the other connector.

The foregoing description of the preferred embodiments of the invention has been presented for the purpose of illustration and description only. It is not intended to be exhaustive or to limit the invention to the precise form disclosed, and modifications and variations are possible in light of and within the scope of the invention. The preferred embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and equivalents thereof.

[Advantageous Effects of the Invention]

As described above, in the present invention, the high-precision wire feed can be effected in the manufacturing of wire harnesses or the like.

What is claimed is:

1. A method of ensuring a wire feed amount in a manufacturing of wire harnesses comprising:

feeding a plurality of wires a set length by driving a feed roller with a motor;

detecting an actual feed amount of each of the plurality of wires being fed by the feed roller independent of the feed roller and the motor;

comparing said actual feed amount with said set length given as an instruction to said feed roller; and controlling a rotation of said motor so that said actual feed amount coincides with said set length, when a difference between said actual feed amount and said set length is more that a set tolerance.

2. A method of ensuring a wire feed amount in the manufacturing of wire harnesses according to claim 1, wherein said plurality of wires are arranged in a juxtaposed manner in a flush plane, and wherein feeding the plurality of wires includes selectively feeding each of the plurality of wires.

3. A method of ensuring a wire feed amount in the manufacturing of wire harnesses according to claim 2, wherein said feed roller is in contact with all said plurality of wires in a direction of juxtaposition of said wires, and the plurality of wires are disposed between said feed roller and a plurality of press rollers corresponding respectively to said wires, and wherein feeding the plurality of wires includes selectively pressing said press roller against said feed roller.

4. Apparatus for ensuring a wire feed amount in the manufacturing of wire harnesses comprising:

driving means for driving a feed roller which feeds a plurality of wires a set length given as an instruction to said feed roller;

detecting means for detecting an actual feed amount of each of the plurality of wires independent of the feed roller and the motor; and controlling means for controlling said driving means so that the actual feed amount coincides with the set length.

5. Apparatus for ensuring a wire feed amount in the manufacturing of wire harnesses according to claim 4, wherein said control means compares said first feed amount with said second feed amount, and rotates said driving means for said feed roller when a difference between said first feed amount and said second feed amount is more than a set tolerance, to thereby perform a feedback control.

6. Apparatus for ensuring a wire feed amount in the manufacturing of wire harnesses according to claim 5, wherein said driving means comprises a servo motor having a position control amplifier, said detecting means comprises a length-measuring roller directing detecting an amount of movement of each of said fed plurality of wires and an encoder taking out a rotation of said length measuring roller as a pulse signal, and further wherein said pulse signal taken out from said encoder is compared by said controlling means with a feed instruction pulse value given to said position control amplifier of said servo motor, and a correction instruction pulse value computed by said controlling means is fed back to said position control amplifier.

7. Apparatus for ensuring a wire feed amount in the manufacturing of wire harnesses according to claim 5, in which the plurality of wires are arranged in a juxtaposed manner in a flush plane, said feed roller is in contact with all the plurality of wires in a direction of juxtaposition of said wires, said plurality of the wire are disposed between said feed roller and a plurality of press rollers corresponding respectively to the wires, and said press roller are selectively pressed against said feed roller, thereby selectively feeding the wires;

wherein said detecting means are provided respectively for said fed wires, and a detection signal from each of said detecting means is inputted into said controlling means, thereby effecting a feedback control for each of said wires.

8. Apparatus for ensuring a wire feed amount in the manufacturing of wire harnesses according to claim 7, wherein said detecting means comprises length-measuring rollers provided respectively for the juxtaposed wires and arranged in a staggered manner in a direction of juxtaposition of said wires, and encoders detecting a number of revolutions of each of said length-measuring rollers.

9. A mechanism for detecting an amount of travel of wires traveling in a juxtaposed manner comprising;

length-measuring rollers provided respectively for the juxtaposed wires, said length-measuring rollers being arranged in a staggered manner in a direction of juxtaposition of said wires, and an encoder that detects a number of revolutions of each of said length-measuring rollers, thereby detecting the amount of travel of each wire.

* * * * *